US005806532A

United States Patent [19]

Kuenzel

[11] Patent Number: 5,806,532

[45] Date of Patent: Sep. 15, 1998

[54] SELF-EJECTING CIGAR CORE CUTTER

[76] Inventor: Kurt I. Kuenzel, Apartment A5 7655 Whispering Brook Dr., Portage, Mich. 49002

[21] Appl. No.: 927,720

[22] Filed: Sep. 11, 1997

[51] Int. Cl.[6] ..... A24F 13/20

[52] U.S. Cl. ..... 131/248; 131/254; 131/255

[58] Field of Search ..... 131/255, 254, 131/233, 237, 248, 250, 258; 30/113, 109, 110; 604/227

[56] References Cited

U.S. PATENT DOCUMENTS

| | | | |
|---|---|---|---|
| 297,956 | 4/1884 | Ungerer | 131/248 |
| 308,906 | 12/1884 | Larsen et al. | 131/255 |
| 376,511 | 1/1888 | Carter | 131/248 |
| 436,269 | 9/1890 | Schöler | 131/248 |
| 706,679 | 8/1902 | Mountford | 131/248 |
| 744,893 | 11/1903 | Bailey | 131/248 |
| 1,284,566 | 11/1918 | Benson | 131/248 |
| 1,434,599 | 11/1922 | Field et al. | 131/248 |
| 1,910,342 | 5/1933 | Kivikink | 131/248 |
| 2,843,135 | 7/1958 | Lisiewski | 131/248 |
| 5,535,763 | 7/1996 | Conte | 131/248 |

FOREIGN PATENT DOCUMENTS

| | | | |
|---|---|---|---|
| 13641 | 9/1988 | United Kingdom | 131/255 |

*Primary Examiner*—John G. Weiss
*Assistant Examiner*—Charles W. Anderson
*Attorney, Agent, or Firm*—The Firm of Gordon W. Hueschen

[57] ABSTRACT

A self-ejecting cigar core or plug cutter having a cylindrical barrel, a slidable cylindrical cutting tube inside the barrel, and a solid cylindrical core member inside the cutting tube, the cutting tube extending rearwardly and being secured to a knob, a spring normally biasing the cutting tube rearwardly so that its forward cutting edge is normally inside the barrel, and an L-slot on opposite sides of the cutting tube, with a pin extending through the slot and through the inner core and being secured at both ends in the barrel, whereby pushing in and turning the knob compresses the spring and forces the forward cutting edge of the cutting tube out of the forward edge of the barrel for cutting a plug out of a cigar, and whereby turning of the knob in the opposite direction releases the forward spring bias and permits the cutting tube to retract into its normal position inside the barrel, the plug cut from the cigar being ejected from the cutting tube by the inner core within the cutting tube upon retraction of the cutting tube.

14 Claims, 3 Drawing Sheets

SELF-EJECTING CIGAR CORE CUTTER

FIELD OF THE INVENTION

Self-ejecting cigar core cutters.

BACKGROUND OF THE INVENTION AND PRIOR ART

Cigars have long been popular and have recently experienced renewed interest on the part of smokers. With this renewed interest comes the need for an improved cigar-core cutter, especially of the self-ejecting type. The present invention fulfills just such a need.

The prior art is replete with cigar core cutters of various types.

Searches conducted in Class 131, subclasses 248, 252, 253, and 255 and in Class 30, subclasses 111 and 113 and somewhat beyond, turned up the following U.S. Patents on cigar core cutters:

U.S. Pat. No, 297,956: Finger-operated, not spring-biased or automatic.

U.S. Pat. No. 376,511: Same, having a spiral slot or groove and a pin for turning the inner tube and its cutter when the tube is slid inwardly.

U.S. Pat. No. 436,269: Same, with a plunger F adapted to move longitudinally to eject tobacco removed from the cigar by means of tubular cutter A when the cigar is removed from the socket 8.

U.S. Pat. No. 706,679: A rather complicated manually-operated 1902 piercing patent, wherein rearwardly biased section 2 is pushed and held within tube 1 to force piercing edge 15 into the cigar tip and one arm of U-shaped extractor 22 extends into slot 20 and through aperture 25 and into tube 12 to clean out tube 12 when the pressure upon tube 2 is manually released and tube 12 is retracted into tube 1, forcing one arm of U-shaped extractor 22 into tube 12 for ejecting the debris therefrom.

U.S. Pat. No. 744,893: Core means passes through piercing member 9 or 12 and out of the other end as at 10 or 20, the spring holding the piercing member at any desired position within the outer shell.

U.S. Pat. No. 1,284,566: Cutter 4 with cylindrical cutting edges 5 with ejection from space 6 to the rear of cutting head by the plunger 2 which is spring-biased by spring 13, the spring-bias returning the plunger to normal position within tubular body 1 after head 8 of the plunger 2 is pressed into the cigar and then released, the core thus being ejected from aperture 6 to the rear of cutting edges 5.

U.S. Pat. No. 1,434,599: Plunger 8 ejects the plug when cylindrical knife 4 is withdrawn by pulling on ring 9 after head 5 is pressed in to cause knife 4 to enter the cigar end. Pin 6 serves as a stop for knife 4, limiting its movement in both directions.

U.S. Pat. No. 1,910,342: Spring-biased hollow broach is manipulated by a plunger including a cleaning rod 14 which can be withdrawn and then manipulated into the cutting end and into the bore of the broach 7 for purposes of cleaning the bore of cores of cigar material.

U.S. Pat. No. 2,843,135: A tongue 40 within tube 34 but, for ejection of the core, head 12 must be unscrewed from the barrel 10 and the spring-biased plunger 14 then removed from the barrel.

U.S. Pat. No. 5,535,763: A complicated manual non-sliding cutter, not a sliding cutter, with no internal spring bias, but with separate independently movable plunger and collar for removal of debris.

Thus, none of the prior art patents turned up by the search embody the structural features incorporated in the self-ejecting cigar core cutter of the present invention or provide the numerous advantages thereof.

The Present Invention—In General

The present invention provides a unique self-ejecting cigar core cutter comprising an independent solid core and an independent cutting tube or sleeve surrounding the solid core inside of the main body or barrel of the device. The solid core and the surrounding cutting tube or sleeve are both anchored by means of a pin in the barrel of the device and the cutting tube extends beyond the barrel and is affixed to a knob. A coil spring internal of the cutting tube and seated against an end of the solid core is located inside the main body of the device to provide a rearward spring bias to the tube. The cutting tube or sleeve can move slidably with respect to the barrel and core and there is an L-slot on both sides of the cutting tube so that, when the knob is pushed in and turned to the right, the pin adjusts itself by means of the lateral L-slot segment to hold the cutting tube or sleeve in forward extended position at the front end of the device with respect to the core. Preferably the cutting tube or sleeve has an inside bevel, the better to extract the plug from the cigar and to permit its ejection therefrom.

By way of operation, to operate the present self-ejecting cigar core cutter, the knob is pushed in, overcoming the rearward spring bias, and turned to the right, locking the cutting tube in extended position. Then one pushes the cutting tube or sleeve into the cigar head and rotates the same. When the cutting tube or sleeve is removed from the cigar head, it contains the plug from the cigar. To eject the plug, the knob of the core cutter is simply turned to the left, at which point the plug is ejected as the cutting tube or sleeve is again retracted over the inner core and into the barrel of the device due to resumption of the rearward spring bias as the pin enters a longitudinal segment of the L-slot.

OBJECTS OF THE INVENTION

It is an object of the present invention to provide a unique and superior self-ejecting cigar core cutter.

Another object of the invention is to provide a self-ejecting cigar core cutter which is of one-piece construction when assembled and which can be manipulated with a single hand. A further object of the invention is to provide such a self-ejecting cigar core cutter having a cutting tube with a scalloped edge which facilitates faster cutting into the cigar and which leads to longer service of the device. A still further object of the invention is to provide such a self-ejecting cigar core cutter which controls the depth of the cut automatically and which automatically ejects the plug cut from the cigar, both upon simple rotation of a knob.

Other objects of the invention will be obvious to one skilled in the art and still others will become apparent from a reading of the Specification which follows.

SUMMARY OF THE INVENTION

What I believe to be my invention, then, inter alia, comprises the following, alone or in combination, and may be summarized as follows:

A self-ejecting cigar core cutter comprising the following elements in combination:

- a solid cylindrical inner core member having forward and rearward ends,
- a cylindrical cutting tube or sleeve member mounted over said inner core member, having a forward cutting edge and a rear end, a cylindrical housing or barrel member having forward and rearward edges surrounding said inner core member and said cutting tube member, said cutting tube member being in slidable relationship with said barrel member and said inner core member and extending rearwardly beyond the rearward edge of said barrel member, a knob member affixed to the rear end of said cutting tube member, spring biasing means operatively associated with said cutting tube member which, in normal extended condition, biases said tube member rearwardly so that its forward cutting edge does not extend beyond the forward edge of said barrel member and which, in compressed condition, permits said cutting tube member to advance forwardly so that its forward cutting edge extends beyond the forward edge of said barrel member, retention means for retaining said spring biasing means in compressed condition and said cutting tube member with its forward cutting edge extended beyond the forward edge of said barrel member and means for releasing said spring biasing means to assume its extended condition and said cutting tube member to assume its normal position with its forward cutting edge not extending beyond the forward edge of said barrel member, and means for securing said cutting tube member and said inner core member in association with said barrel member whether said spring biasing means is under compression or extended, and means for changing said spring biasing means from a condition in which it is extended to a condition in which it is compressed and vice versa, whereby, upon pushing in said knob member and engaging said retention means, said spring is compressed and said cutting tube member is extended outwardly beyond the forward edge of said barrel member and whereby, upon releasing said knob and disengaging said retention means, said spring biasing means is extended and said cutting tube member is retracted into said barrel member, thereby ejecting any plug within said cutting tube member by retraction of said cutting tube member over said inner core member; such a self-ejecting cigar core cutter wherein said means for retention and release is an L-slot on opposite sides of said cutting tube member and a pin in said slot extending through said cutting tube member and said inner core member and secured at both ends in said barrel member; such a self-ejecting cigar core cutter wherein said means for securing said cutting tube member and said inner core member in association with said barrel member is a pin extending through both said members and secured at both ends in said barrel member; such a self-ejecting cigar core cutter wherein said pin securing said cutting tube member and said inner core member in association with said barrel member is the same pin which extends through said L-slot; such a self-ejecting cigar core cutter wherein said means for changing said spring biasing means from said compressed condition to said extended condition is activated by turning said knob member to which said cutting tube member is affixed; such a self-ejecting cigar core cutter wherein said means for changing said spring biasing means from said extended condition to said compressed condition is actuated by pushing in and turning said knob member to which said cutting tube member is affixed; such a self-ejecting cigar core cutter wherein the forward cutting edge of said cutting tube is scalloped; such a self-ejecting cigar core cutter wherein the forward edge of the barrel member is radiused so as to provide a better seat for the head of a cigar inserted therein; such a self-ejecting cigar core cutter wherein the forward cutting edge of the cutting tube member is chamfered to an inside bevel; such a self-ejecting cigar core cutter wherein said knob member is affixed to said cutting tube member by means of a pin; such a self-ejecting cigar core cutter wherein one end of said spring biasing means is seated against said pin; such a self-ejecting cigar core cutter wherein the other end of said spring biasing means is in abutting engagement with the rearward end of said inner core member; and such a self-ejecting cigar core cutter wherein said spring biasing means is inside said cutting tube member and seated at one end against said pin affixing said knob member to said cutting tube member and at the other end inside said cutting tube member and seated against the rearward end of said inner core member.

Moreover, a self-ejecting cigar core cutter comprising the following elements in combination:

a solid cylindrical inner core member, a cylindrical cutting tube or sleeve member mounted over said inner core member, having a forward cutting edge and a rear end, a cylindrical housing or barrel member having forward and rearward edges surrounding said inner core member and said cutting tube member, said cutting tube member being in slidable relationship with said barrel member and said inner core member and extending rearwardly beyond the rearward edge of said barrel member, a knob member affixed to the rear end of said cutting tube member, spring biasing means operatively associated with said cutting tube member which, in normal extended condition, biases said tube member rearwardly so that its forward cutting edge does not extend beyond the forward edge of said barrel member and which, in compressed condition, releases said cutting tube member to advance forwardly so that its forward cutting edge extends beyond the forward edge of said barrel member, L-slot means, having a rearward transverse leg and a forward longitudinal leg, on opposite sides of said cutting tube and a pin extending through said L-slot means and through said inner core member and secured at both ends in said barrel member, whereby upon pushing in said knob member and turning the same to engage said pin in said rearward transverse leg of said slot means said spring is compressed and said cutting tube member is extended outwardly beyond the forward edge of said barrel member and whereby, when said knob is turned and said pin is disengaged from said rearward transverse leg of said L-slot means and allowed to enter said longitudinal forward leg of said slot means, said spring biasing means is extended and said cutting tube member is retracted into said barrel member, thereby ejecting any plug within said cutting tube member by retraction of said cutting tube member over said inner core member.

DESCRIPTION OF THE DRAWINGS

Reference is now made to the drawings wherein.

DESCRIPTION OF THE PREFERRED EMBODIMENTS

Reference is now made to the drawings, wherein the elements are numbered consecutively and wherein the same numbers are used to refer to the same elements throughout.

Figure 1:
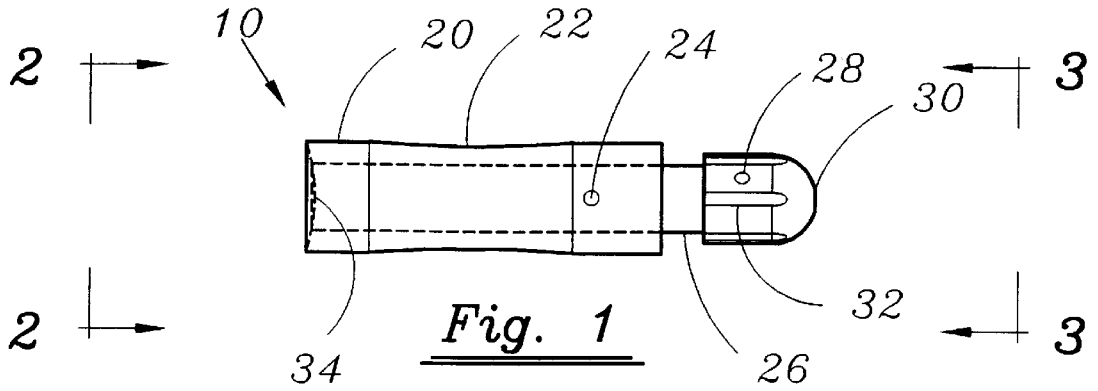
FIG. 1 is an elevational view of the fully-assembled self-ejecting cigar core cutter of the invention.
Figure 4:
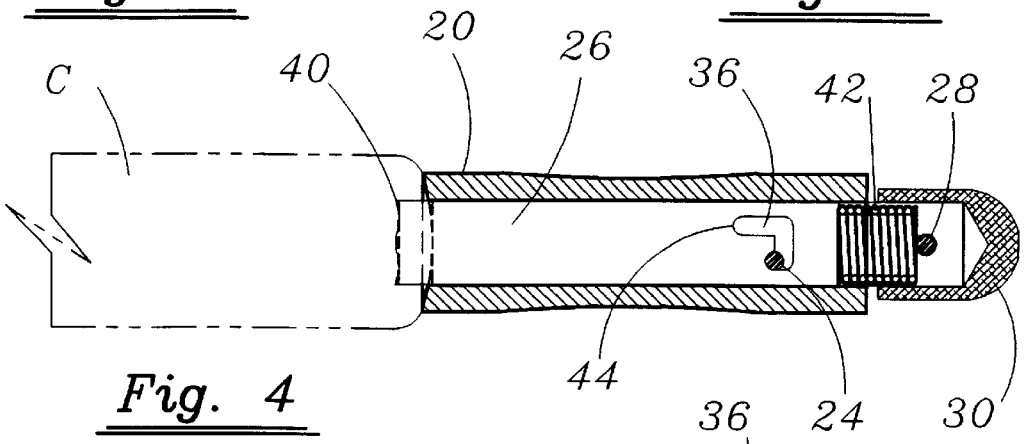
FIG. 4 is a cut-away section of the cutter of FIG. 1 showing the cutting tube in extended position.

Referring now to FIG. 1, the assembled cutter is generally shown at 10, wherein the barrel of the device is shown at 20, having a slight recess at 22 to make the cutter easier to hold. Pin 24 holds inner core 36 stationary and in place and also serves as a locking device for slidable cutting tube 26 in L-slot 44, as shown in FIG. 4, which includes a J-slot, being a mere modification of an L-slot. At 34 is shown a radiused end of the barrel 20 for better seating of the head of the cigar when inserting and rotating cutting tube 26 to cut out the plug P, whereas the cutting tube itself is shown at 26 with knurled or grooved knob 30 attached thereto by pin 28 having grooves 32 in the surface thereof to make it easier to grip the knob.

Figure 2:
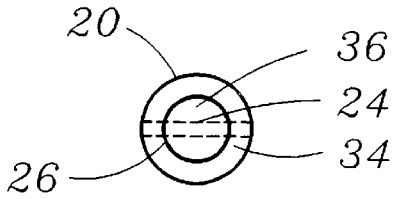
FIG. 2 is a left end view of the cutter of FIG. 1.

From the left-end view of FIG. 2 are seen barrel 20 and cutting tube 26 with inner core 36 and radiused end of barrel 34. Pin 24, which holds the core stationary and in place and is also the locking device used in slot 44 is merely indicated at 24.

Figure 3:
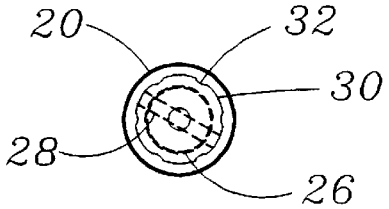
FIG. 3 is a right end view of the cutter of FIG. 1, partially in section.

From the opposite end view of FIG. 3 are apparent barrel 20 with cutting tube 26 inside knob 30 having grooves 32 thereon and pin 28 which holds the knob 30 and cutting tube 26 together.

From the cut-away section of FIG. 4, which shows the cutting tube 26 in rotated, locked, and extended position at 40, it is seen that, by pushing in knob 30, coil spring 42 anchored against pin 28 at one end and seated against the rearward inner core 36 at its other end, is compressed, thereby forcing cutting tube 26 forwardly and into extended position out the end of barrel 20 and around the external circumference of core 36. Knob 30 is then rotated slightly to the right to place pin 24 into the rearward or transverse leg of L-slot 44, thereby securing the cutting tube 26 in extended position. As shown, cigar C has its head nested against the radiused end 34 of barrel 20 and the scalloped cutting edge of cutting tube 26 extended as shown at 40 has been forcibly inserted with rotation into the head portion of cigar C. The inner core 44 of the device is visible only through the slot 36 in cutting tube 40.

Figure 5:
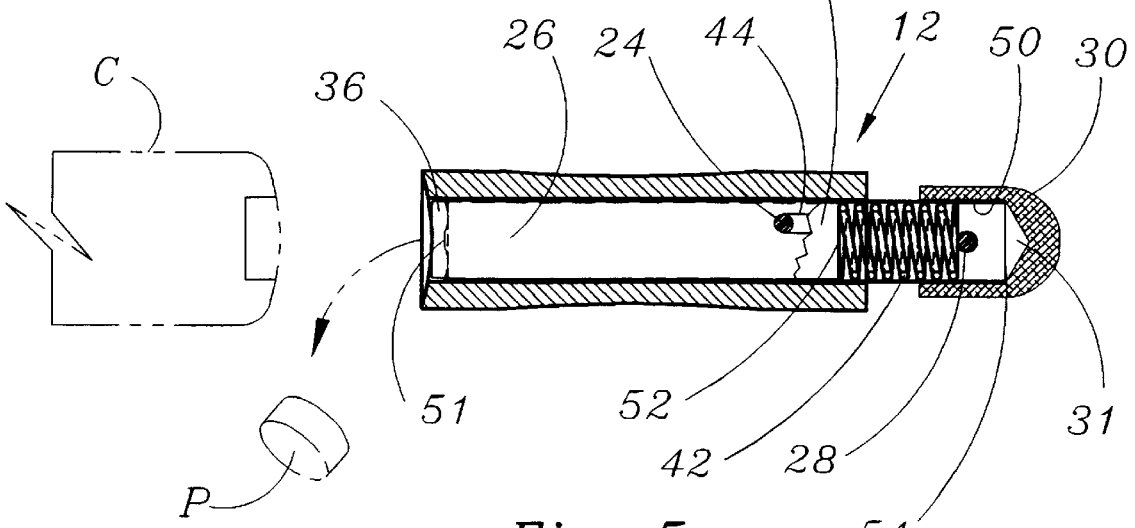
FIG. 5 is the same as FIG. 4 but further cut away to show the inner core and showing the cutting tube in retracted position, which pushes the plug out of the cutting tube.

From FIG. 5, the inside diameter of cutting tube 26, inside of which spring 42 resides, is shown at 50, as well as the end of cutting tube 54 which fits snugly into the interior opening 31 of knob 30 and abuts an end wall of said opening; the spring 42 now being shown in relaxed or extended position in view of rotation of the knob 30 and the attached cutting tube 26 to the right to place pin 24 in the forward or longitudinal leg of the L-slot. A breakaway in cutting tube 26 is shown at 12 for purposes of exposing the external surface of the core 36 and the spring 42. As shown, tube 26 is cut away to expose inner core 36 and the rearward end of the core 52 which provides a seat for one end of spring 42, the other end being seated against pin 28. Scalloped cutting edge 51 of cutting tube 26 is also shown, now in normal retracted position, and plug P taken from the head of cigar C is shown as having been ejected by retraction of cutting tube 26 about the external surface of inner core 36, thereby ejecting plug P from tube 26.

Figure 6:
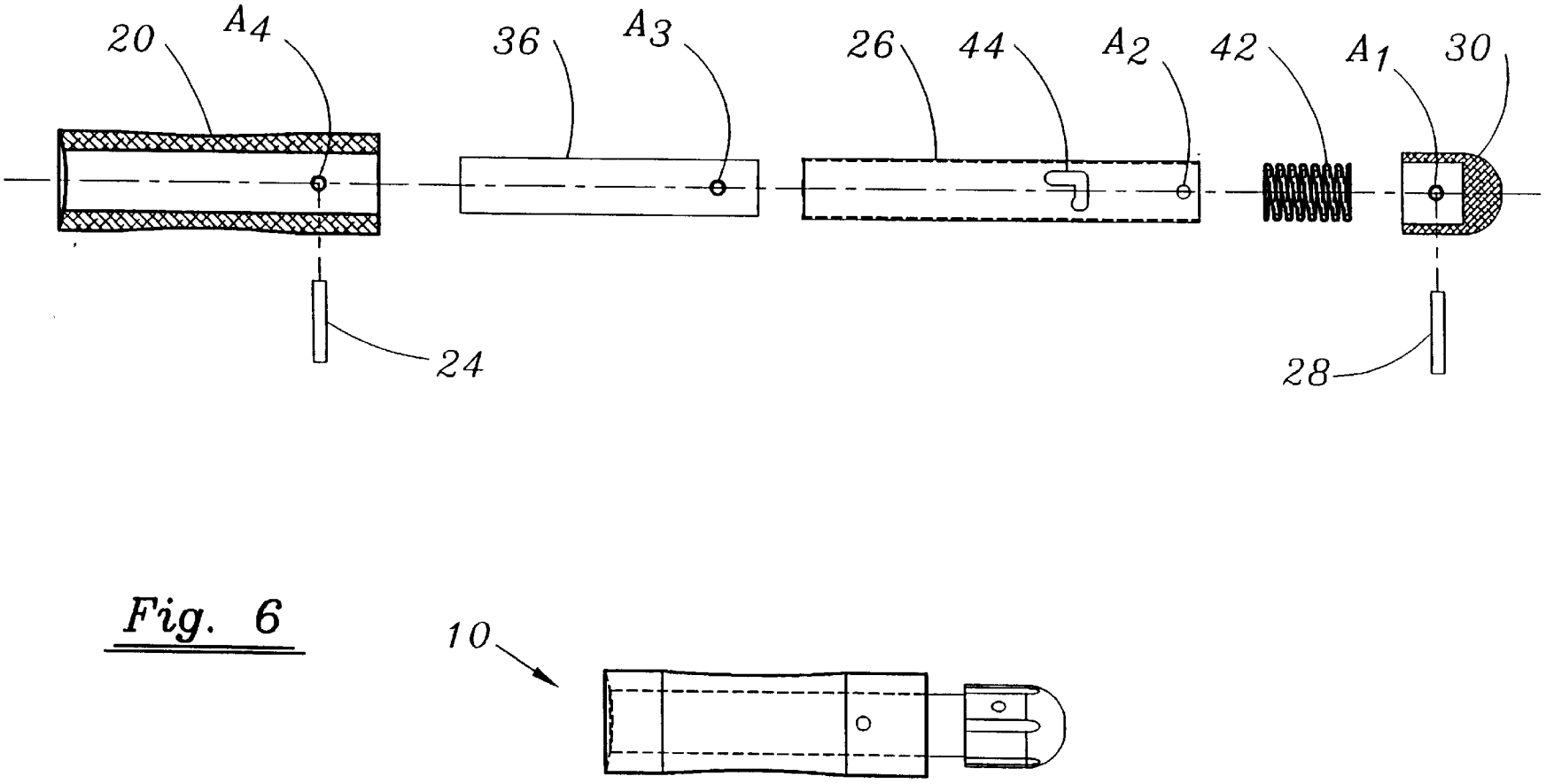
FIG. 6 is an exploded assembly view of the cutter of FIG. 1 showing each component thereof.

From FIG. 6 all of the elements previously mentioned are shown in an exploded view, the apertures in the various elements for receiving pins 24 and 28 being respectively designated A1, A2, A3, and A4, these apertures being respectively in the knob 30, in the tube 26, in the core 36, and in the barrel 20. Pin 24 extends through slot 44 and A3 and is anchored at both ends in A4. Pin 28 extends through A2 and is anchored at both ends in A1.

Figure 7:
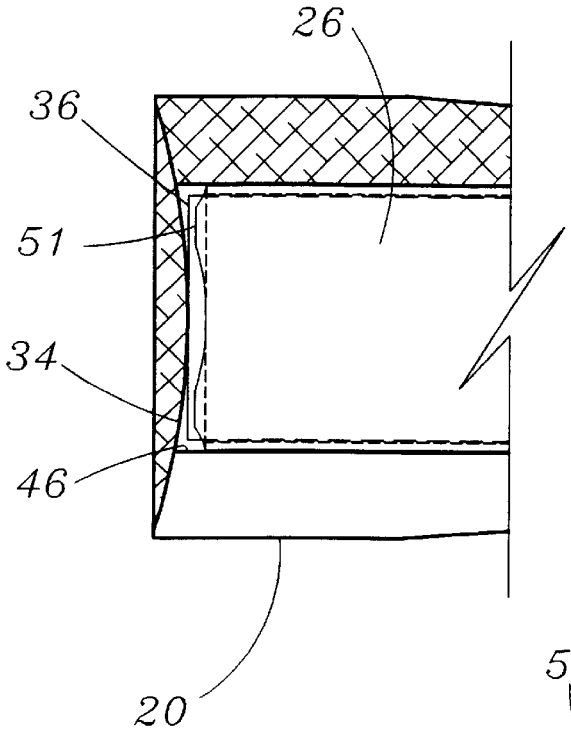
FIG. 7 is an enlarged partial section according to FIG. 5 showing the core of the cutter of the invention extending beyond the cutting tube.

From FIG. 7 is seen the core 36 extending beyond the scalloped cutting edge 51 of tube 26, the radiused edge 34 of barrel 20 near which the end of cutting tube 26 sits when in retracted position, and the inside diameter 46 of the barrel 20 within which the cutting tube 26 slides. The same elements are visible from FIG. 8, and in addition the chamfer to an inside bevel at 56 making a sharp edge in cutting tube 26 for better cutting of the plug, as well as forward portion of scalloped cutting edge 51 of cutting tube 26 and recessed area 53 thereof, altogether comprising the superior forward scalloped cutting edge of cutting tube 26.

Figure 8:
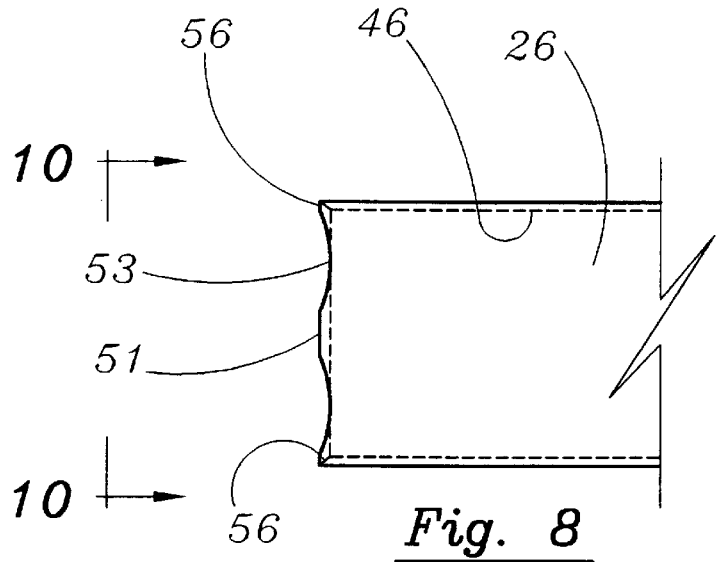
FIG. 8 is a partial cut-away top view of the cutting tube.
Figure 10:
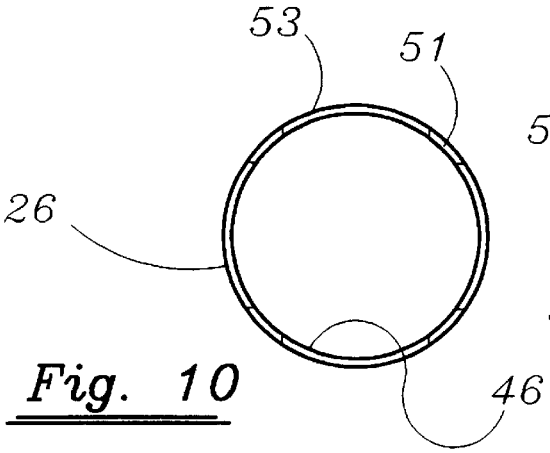
FIG. 10 is an end view of FIG. 8.
Figure 9:
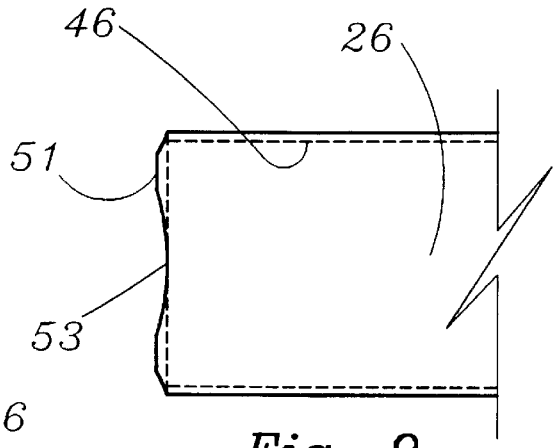
FIG. 9 is a partial cut-away side view of the cutting tube taken from the same side as FIG. 7, this being the same view as FIG. 8 but rotated 90°.

The same elements are again shown in FIG. 9, which is the same as FIG. 8 except that cutting tube 26 is rotated 90° and, finally, these same elements are visible in the view of FIG. 10 which is an end view of FIG. 8.

OPERATION

In operation, the self-ejecting cigar core cutter of the invention is simple, effective, and foolproof. To operate, the knob 30 is simply pushed in and turned to the right, thereby securing the pin 24 in the rearward or transverse leg of L-slot 44. With the forward edge 40 of the cutting tube 26 thus extended, it is simply rotated into the head of a cigar C to define the plug P which it is desired to remove from the cigar head. Then, the knob 30 is turned to the left to allow the pin 24 to move into the forward and longitudinal leg of the L-slot 44, thereby permitting the cutting tube 26 to retract and thereby ejecting the plug P when it comes into contact with the inner solid core 36 within tube 26.

The L-slot 44 is located on opposite sides of the cutting tube 26, and the pin 24 extends through both of said L-slots 44. The stroke depends on the length of the longitudinal leg of the slot 44 and may be ¼ of an inch or less, optimally about ⅛ of an inch, and in any event is sufficient so that the cutting tube 26 can move with respect to the core and barrel a sufficient distance for it to be extended outside of the barrel 20 for core cutting and then to be retracted inside the barrel 20 for expulsion of the plug P from within the cutting tube 26 by core 36, the extension and retraction being determined by the coil spring 42 as it is compressed or extended by pressure upon knob 30 and as retained in compressed condition or permitted to regain extended condition by the action of pin 24 within the different legs of L-slot 44.

It will apparent to one skilled in the art that, by reversal of the position of the L-slot 44, exactly the same results can be obtained, but that, instead of pushing in the knob 30 and turning it to the right for purposes of compressing the spring 42, with a reverse L-slot 44, it would be pushed in and turned to the left and, to retract the cutting tube 26 and to bring the spring 42 once again into relaxed or extended condition, in such case the knob 30 would simply be turned to the right to effect exactly the same result but in reverse, due to the reverse positioning of the L-slot 44 which controls the pin 24 which in turn controls the retention of the compressed spring 42 or release thereof back into its original relaxed or extended position. Thus, by a simple reversal of the L-slot 44, exactly the same results can be obtained, but the knob 30 would be turned in the opposite direction for retention of the spring 42 in compressed condition and for relaxation thereof, with accompanying extension of the forward cutting edge 40 of the cutting tube 26 into cutting position and retraction thereof over the internal core 36 and into the barrel 20 of the self-ejecting core cutter of the present invention.

A unique and novel and advantageous self-ejecting cigar core cutter has thus been disclosed and is provided by the present invention, whereby all of the desirable objectives of the present invention have been attained.

It is to be understood that the present invention is not to be limited to the exact details of operation, or to the exact compounds, compositions, materials, methods, procedures, or embodiments shown and described, as various modifications and equivalents will be apparent to one skilled in the art, wherefore the present invention is to be limited only by the full scope which can be legally accorded to the appended claims.

I claim:

1. A self-ejecting cigar core cutter comprising the following elements in combination:

a solid cylindrical inner core member having forward and rearward ends, a cylindrical cutting tube or sleeve member mounted over said inner core member, having a forward cutting edge and a rear end, a cylindrical housing or barrel member having forward and rearward edges surrounding said inner core member and said cutting tube member, said cutting tube member being in slidable relationship with said barrel member and said inner core member and extending rearwardly beyond the rearward edge of said barrel member, a knob member affixed to the rear end of said cutting tube member, spring biasing means operatively associated with said cutting tube member which, in normal extended condition, biases said tube member rearwardly so that its forward cutting edge does not extend beyond the forward edge of said barrel member and which, in compressed condition, permits said cutting tube member to advance forwardly so that its forward cutting edge extends beyond the forward edge of said barrel member, retention means for retaining said spring biasing means in compressed condition and said cutting tube member with its forward cutting edge extended beyond the forward edge of said barrel member and means for releasing said spring biasing means to assume its extended condition and said cutting tube member to assume its normal position with its forward cutting edge not extending beyond the forward edge of said barrel member, and means for securing said cutting tube member and said inner core member in association with said barrel member whether said spring biasing means is under compression or extended, and means for changing said spring biasing means from a condition in which it is extended to a condition in which it is compressed and vice versa, whereby, upon pushing in said knob member and engaging said retention means, said spring is compressed and said cutting tube member is extended outwardly beyond the forward edge of said barrel member and whereby, upon releasing said knob and disengaging said retention means, said spring biasing means is extended and said cutting tube member is retracted into said barrel member, thereby ejecting any plug within said cutting tube member by retraction of said cutting tube member over said inner core member.

2. The self-ejecting cigar core cutter of claim 1 wherein said means for retention and release is an L-slot on opposite sides of said cutting tube member and a pin in said slot extending through said cutting tube member and said inner core member and secured at both ends in said barrel member.

3.The self-ejecting cigar core cutter of claim 2 wherein said means for securing said cutting tube member and said inner core member in association with said barrel member is a pin extending through both said members and secured at both ends in said barrel member.

4. The self-ejecting cigar core cutter of claim 3 wherein said pin securing said cutting tube member and said inner core member in association with said barrel member is the same pin which extends through said L-slot.

5. The self-ejecting cigar core cutter of claim 1 wherein said means for changing said spring biasing means from said compressed condition to said extended condition is activated by turning said knob member to which said cutting tube member is affixed.

6. The self-ejecting cigar core cutter of claim 5 wherein said means for changing said spring biasing means from said extended condition to said compressed condition is actuated by pushing in and turning said knob member to which said cutting tube member is affixed.

7. The self-ejecting cigar core cutter of claim 1 wherein the forward cutting edge of said cutting tube is scalloped.

8. The self-ejecting cigar core cutter of claim 1 wherein the forward edge of the barrel member is radiused so as to provide a better seat for the head of a cigar inserted therein.

9. The self-ejecting cigar core cutter of claim 1 wherein the forward cutting edge of the cutting tube member is chamfered to an inside bevel.

10. The self-ejecting cigar core cutter of claim 1 wherein said knob member is affixed to said cutting tube member by means of a pin.

11. The self-ejecting cigar core cutter of claim 10 wherein one end of said spring biasing means is seated against said pin.

12. The self-ejecting cigar core cutter of claim 11 wherein the other end of said spring biasing means is in abutting engagement with the rearward end of said inner core member.

13. The self-ejecting cigar core cutter of claim 10 wherein said spring biasing means is inside said cutting tube member and seated at one end against said pin affixing said knob member to said cutting tube member and at the other end inside said cutting tube member and seated against the rearward end of said inner core member.

14. A self-ejecting cigar core cutter comprising the following elements in combination:

a solid cylindrical inner core member, a cylindrical cutting tube or sleeve member mounted over said inner core member, having a forward cutting edge and a rear end, a cylindrical housing or barrel member having forward and rearward edges surrounding said inner core member and said cutting tube member, said cutting tube member being in slidable relationship with said barrel member and said inner core member and extending rearwardly beyond the rearward edge of said barrel member, a knob member affixed to the rear end of said cutting tube member, spring biasing means operatively associated with said cutting tube member which, in normal extended condition, biases said tube member rearwardly so that its forward cutting edge does not extend beyond the forward edge of said barrel member and which, in compressed condition, releases said cutting tube member to advance forwardly so that its forward cutting edge extends beyond the forward edge of said barrel member, L-slot means, having a rearward transverse leg and a forward longitudinal leg, on opposite sides of said cutting tube and a pin extending through said L-slot means and through said inner core member and secured at both ends in said barrel member, whereby upon pushing in said knob member and turning the same to engage said pin in said rearward transverse leg of said slot means said spring is compressed and said cutting tube member is extended outwardly beyond the forward edge of said barrel member and whereby, when said knob is turned and said pin is disengaged from said rearward transverse leg of said L-slot means and allowed to enter said longitudinal forward leg of said slot means, said spring biasing means is extended and said cutting tube member is retracted into said barrel member, thereby ejecting any plug within said cutting tube member by retraction of said cutting tube member over said inner core member.

* * * * *